US005110113A

United States Patent [19]

Kanaya

[11] Patent Number: 5,110,113

[45] Date of Patent: May 5, 1992

[54] DEVICE FOR CONTROLLING SHEET POSITIONING ON AN INTERMEDIATE TRAY

[75] Inventor: Koichi Kanaya, Yokohama, Japan

[73] Assignee: Ricoh Company, Ltd., Tokyo, Japan

[21] Appl. No.: 561,609

[22] Filed: Aug. 1, 1990

[30] Foreign Application Priority Data

Aug. 1, 1990 [JP] Japan ..... 1-197940

[51] Int. Cl.[5] ..... B65H 9/12

[52] U.S. Cl. ..... 271/241; 271/163

[58] Field of Search ..... 271/3, 3.1, 241, 163, 271/301, 65, 186, 220, 221, 223, 224; 355/317, 318, 319, 320

[56] References Cited

U.S. PATENT DOCUMENTS 4,466,733 8/1984 Pels ..... 355/319
4,607,834 8/1986 Dastin ..... 271/223 X
4,657,239 4/1987 Ikesue et al. ..... 271/240 X
4,824,090 4/1989 Booth, Sr. et al. ..... 271/223 X
4,949,134 8/1990 Iwaki et al. ..... 355/311 X
4,978,111 12/1990 Kosugi et al. ..... 271/3.1

FOREIGN PATENT DOCUMENTS 0162760 12/1981 Japan ..... 355/23
59-143853 8/1984 Japan ..... 271/221
1104526 4/1989 Japan ..... 271/223

*Primary Examiner*—David H. Bollinger
*Attorney, Agent, or Firm*—Oblon, Spivak, McClelland, Maier & Neustadt

[57] ABSTRACT

A device for controlling positioning of a sheet carrying an image on one side thereof, or one-sided sheet, in a predetermined position on an intermediate tray of a copier which is operable in a two-sided copy mode. The one-sided sheet is positioned on the intermediate tray by a pair of side fences and a back fence. The side fences and the back fence each is driven by an exclusive pulse motor to move and stop at a position matching the size of the sheet. Particular amounts of displacement are assigned to each fence on a sheet size basis, and each is adjustable on the operation board of the copier.

6 Claims, 8 Drawing Sheets

| SIZE | SHEET WIDTH W (mm) | DISPLACEMENT L (mm) | | NUMBER OF PULSES P (pls) | |
|---|---|---|---|---|---|
| A3 | 420 | LA3 | 40 | PA3 | 80 |
| B4 | 364 | LB4 | 68 | PB4 | 136 |
| A4 | 297 | LA4 | 101.5 | PA4 | 203 |
| B5 | 257 | LB5 | 121.5 | PB5 | 243 |

| FIG.8A |
| --- |
| FIG.8B |

DEVICE FOR CONTROLLING SHEET POSITIONING ON AN INTERMEDIATE TRAY

BACKGROUND OF THE INVENTION

The present invention relates to a control device for a copier of the type operable in a two-sided copy mode and, more particularly, to a sheet positioning control device which allows sheets to be fed to and refed from an intermediate tray to be accurately positioned on the tray with no regard to their size.

A copier operable of the type described is extensively used today and has an intermediate tray or two-side tray disposed on a sheet transport path which is provided in the copier. Paper sheets each carrying an image on one side thereof, or one-sided sheets, are sequentially stacked on the intermediate tray and then refed from the tray to an image transferring station to form other images on the other side thereof. A pair of side fences and a back fence are provided on the intermediate tray and movable in matching relation to the size of sheets for positioning the individual sheets on the tray. Specifically, the side fences are reciprocatingly movalbe toward and away from each other over a predetermined width to position the sheets on the tray. At the time of refeed, the side fences are shifted to and held at their predetermined position according to the sheet size so as to serve as a guide. The back fence is movable forward or backward to a predetermined position also matching the sheet size in an intended direction of sheet transport. The back fence maintains the leading edge of the sheet stack on the tray at a predetermined position, whatever the sheet size may be. The side fences and the back fence are driven by exclusive drive sources such as pulse motors which are controlled independently of each other. Specifically, a CPU or similar controller feeds a particular number of pulses assigned to each sheet size beforehand to each pulse motor, whereby each fence is moved by a predetermined distance. On the start of a two-sided copy mode operation and before a one-sided paper sheet enters the intermediate tray, the side fences are once moved to their home position and then to a predetermined position matching the size of sheets which will enter the tray. This is also true with the back fence. In this manner, both the side fences and the back fence are moved away from the individual home positions on the basis of particular numbers of pulses assigned to each sheet size. A home position sensor is located at each of the home positions for determining whether or not the associated fence is located in the home position. Usually, such home position sensors are initially adjusted in position at the time of assembly or shipment of the copier by use of a jig or like implement and then fixed in place by, for example, paint locking. The numbers of pulses are, therefore, determined with reference to the fixed positions of the home position sensors, and the fences are each driven to move a distance associated with the number of pulses.

However, while the copier is actually operated by the user, it sometimes occurs that the size of one-sided sheets entering the intermediate tray is different from their prescribed size. Specifically, the prescribed width of size A3 or similar comparatively large size is 420 millimeters, and the number of pulses is determined accordingly. In practice, however, the actual width of a one-sided sheet of size A3 is often smaller than the prescribed width by about 1.5 to 2.5 millimeters due to shrinkage which is caused by heat at an image fixing station also included in the copier. Then, even if the individual fences are moved on the basis of the predetermined numbers of pulses as with sheets of prescribed size, they fail to position the shrunken sheets accurately on the intermediate tray since the change in width is not compensated for at all. Should the paper sheets be not accurately positioned on the intermediate tray, they would undergo skew or similar undersirable occurence at the time of refeed to the image transferring station. It has been customary, therefore, that a serviceman readjusts the home positions of the individual fences, i.e., the positions of the home position sensors. This, however, renders the maintenance troublesome.

SUMMARY OF THE INVENTION

It is therefore an object of the present invention to provide a control device which allows sheets to be accurately positioned on an intermediate tray at all times with no regard to their size.

It is another object of the present invention to provide a generally improved device for controlling the positioning of paper sheets on an intermediate tray.

A device for controlling positioning of a sheet carrying an image on one side thereof in a predetermined position on an intermediate tray of a copier which is operable in a two-sided copy mode of the present invention comprises sheet position regulating members movably provided on the intermediate tray for positioning the sheet, which has been transported to and stacked on the intermediate tray and will be refed, in the predetermined position, drive sources each for moving and stopping respective one of the sheet position regulating members at a desired position, and a control for controlling the sheet position regulating members and drive sources such that the amounts of displacement of the sheet position regulating members driven by the drive sources are controlled in response to a command which is entered on an operation board of the copier.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
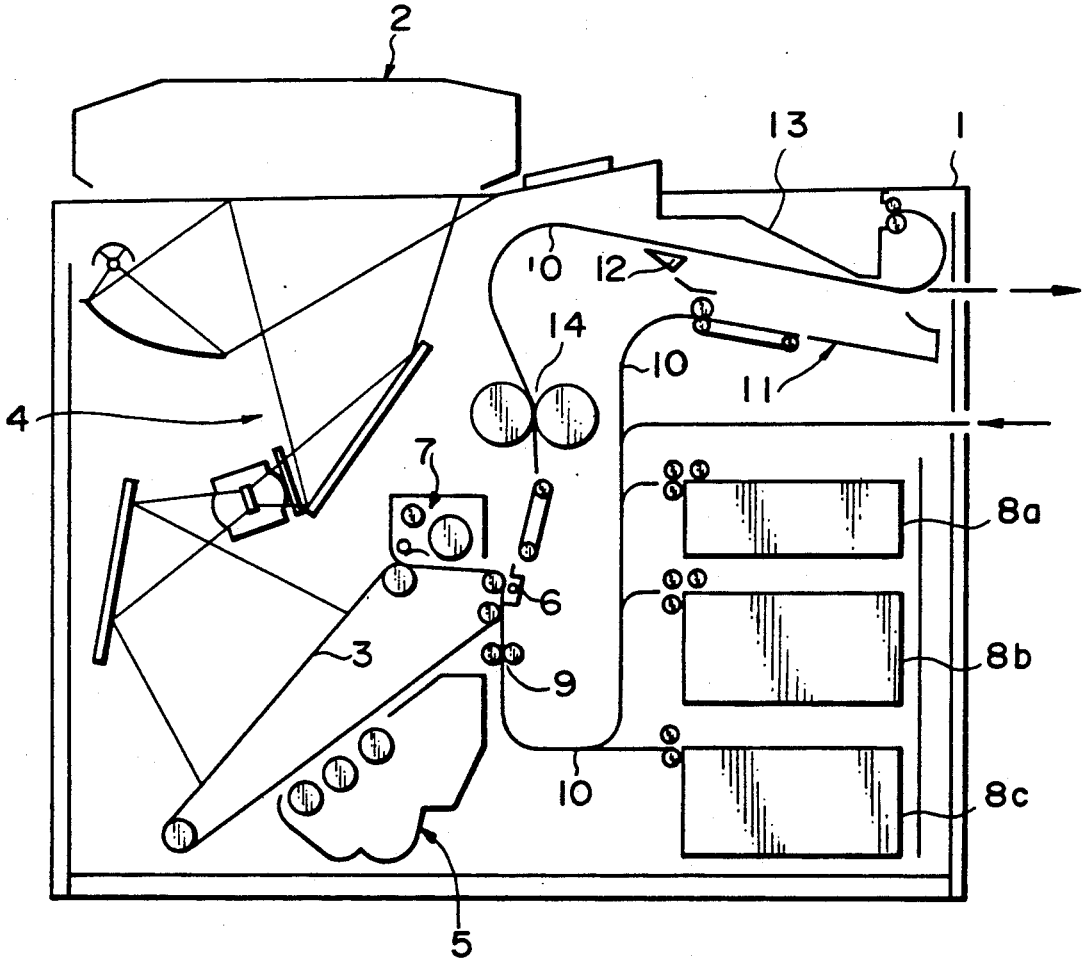
FIG. 1 is a vertical section schematically showing a copier to which the present invention is applicable.

Referring to FIG. 1 of the drawings, a copier to which the present invention is applicable is shown schematically. As shown, the copier has a body 1 and an automatic document feeder (ADF) 2 which per se is well known in the art. The copier body 1 has thereinside a photoconductive element 3, optics 4 for electrostatically forming a latent image representative of a document image on the photoconductive element 3, a developing unit 5, an image transferring unit 6, and a cleaning unit 7. The units 5, 6 and 7 are arranged around the photoconductive element 3. Also arranged in the copier body 1 are a plurality of sheet feeding devices 8*a*, 8*b* and 8*c*, register roller pair 9, and guides 10. An intermediate or two-side tray 11, a selector in the form of a pawl 12, and a copy tray 13 are disposed above the sheet feeding device 8*a*. A fixing unit 14 is interposed between the copy tray 13 and the image transferring unit 6.

In an ordinary one-sided copy mode, a sheet fed from the sheet feeding device 8*a*, for example, is transported to the image transferring unit 6. This unit 6 transfers a tone image to the sheet. The fixing unit 14 fixes the toner image transferred to the sheet by applying heat thereto. The resultant one-sided sheet or copy is driven out to the copy tray 13. In a two-sided copy mode, one-side sheets are steered by the pawl 12 toward the intermediate tray 11 and sequentially stacked thereon. Then, the one-sided sheets are sequentially refed from the tray 11 to form toner images on the other side thereof. The resultant two-sided sheets or copies are driven out to the copy tray 13 via the fixing unit 14. A sorter, stapler or similar finisher may be associated with the copier body 1.

Figure 2:
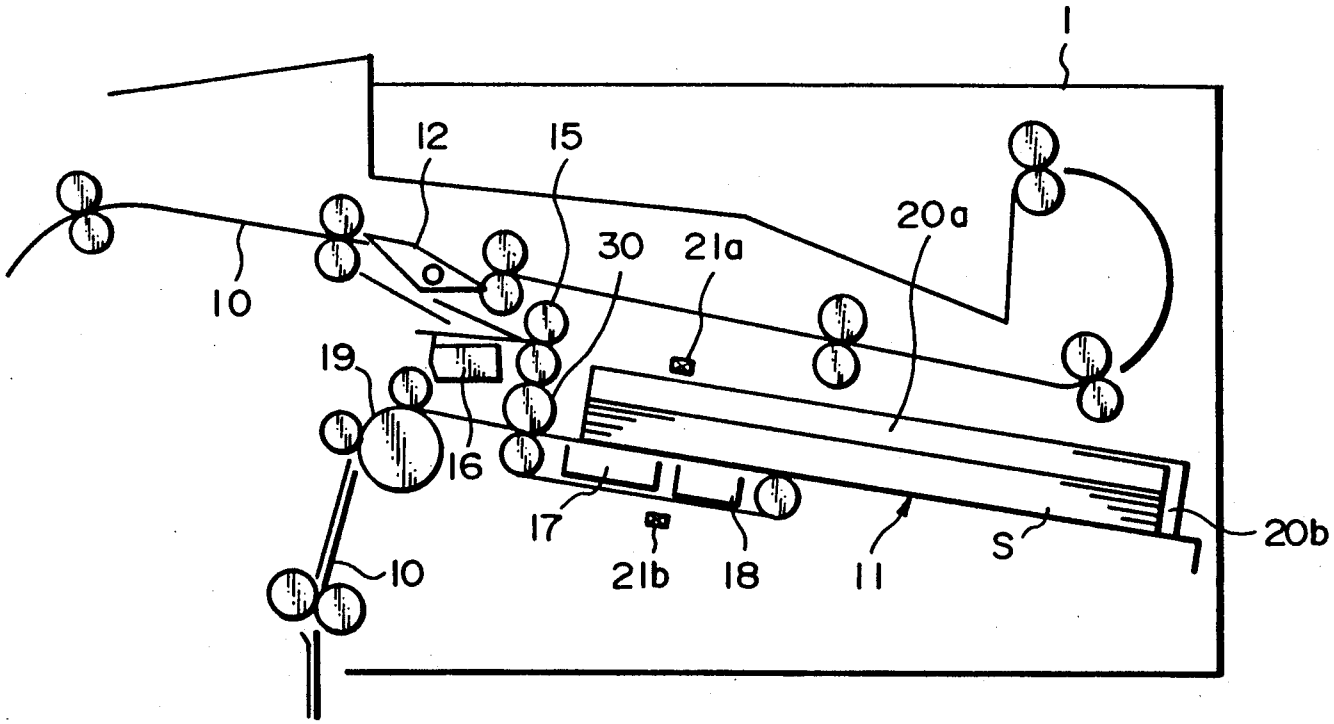
FIG. 2 is a section showing an intermediate tray included in the copier of FIG. 1 together with elements arranged therearound.

FIG. 2 shows the intermediate tray 11 in detail. Sheets S each carrying an image on one side thereof, or one-sided sheets, are sequentially stacked on the tray 11 by a discharge roller pair 15. An air knife 16 blows air into the tray 11 to maintain the sheets S afloat in the tray 11. While such sheets S are continuously stacked on the tray 11, the air knife 1 is so set to cause the stack to remain afloat until up to a predetermined number of sheets S have been stacked. A sucking device 17 is turned on at a predetermined timing to suck the lowermost sheet S, while an endless belt 18 drives the lowermost sheet toward a grip roller 19. Then, the grip roller 19 grips the sheet S to refeed it for the transfer of a toner image. The stream of air from the air knife 16 serves to reduce the coefficient of friction between the nearby sheets S. When the sucking device 17 sucks the lowermost sheet S, the sheet S is spaced apart from the overlying sheet S to allow the stream of air into the resultant space.

Sheet positioning means is disposed in the intermediate tray 11 and made up of a pair of side fences 20*a* and a back fence 20*b*. The side fences 20*a* and back fence 20*b* each is movable in matching relation to the size of the sheets S. A paper end sensor is implemented as a light-sensitive section 21*a* and a light emitting section 21*b* which face each other with the intermediary of the tray 11. The paper end sensor serves to determine whether or not sheets S are present on the tray 11.

The side fences 20*a* have two different functions, i.e., a function of positioning the sheets S while the latter is sequentially stacked and a function of guiding the sheets S while the latter is sequentially refed. Specifically, when the sheets S enter the tray 11 one after another one, the side fences 20*a* are oscillatingly moved toward and away from each other, or opened and closed, over a predetermined width for positioning the sheets S. At the time of refeed, the side fences 20*a* are shifted to their predetermined positions matching the sheet size so as to guide the sheets S. The back fence 20*b* is movable in an intended direction of sheet transport to a particular position which also matches the sheet size, whereby the leading edge of the sheet stack is held at a predetermined distance from a separating roller 30 with no regard to the sheet size. The side fences 20*a* and back fence 20*b* are driven by exclusive pulse motors which are independent drive means. Specifically, they are stopped in an adequate position or moved toward and away from each other with a predetermined amplitude and at a predetermined rate, each in response to the number of pulses and a direction signal which are fed from a CPU which will be described.

Figure 3:
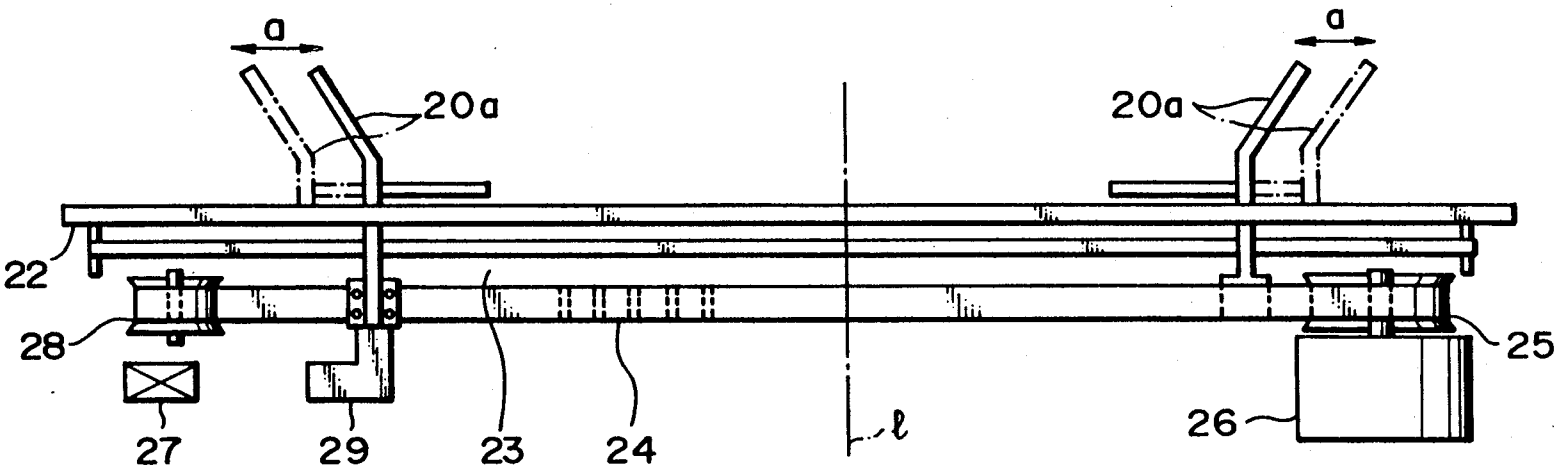
FIG. 3 is a side elevation showing a pair of side fences provided on the intermediate tray of FIG. 2 and a drive mechanism associated therewith.

As shown in FIG. 3, a bottom plate 22, a side fence rail 23, a timing belt 24, a first pulley 25, a pulse motor 26 which has been mentioned, a photointerrupter 27, a second pulley 28, and an interrupting piece 29 are arranged around the side fences 20*a*. The timing belt 24 is partly affixed to the side fences 20*a*, while the interrupting piece 29 is affixed to one of the side fences 20*a*. As the pulse motor 26 is rotated, the first pulley 25 and timing belt 24 move the side fences 20*a*. The side fences 20*a* are positioned at the same distance as each other as measured from the center l at all times. Located at a home position assigned to either one of the side fences 20*a*, the photointerrupter 27 constitutes a side fence home position sensor in cooperation with the interrupting piece 29.

As the copying operation begins in the two-sided copy mode, the pulse motor 26 is rotated in a direction for moving the side fences 20*a* away from each other. As soon as the photointerrupter 27 senses the interrupting piece 29, i.e., on the arrival of the side fence 20*a* at the home position, the pulse motor 26 is deenergized. In the two-sided copy mode, the side fence 20*a* is once brought to such a home position with no regard to the size. Subsequently, the pulse motor 26 is rotated in the other direction to move the side fences 20*a* toward each other until the side fences 20*a* reach their positions matching the size of sheets S which will enter the tray 11. In this instance, the side fences 20*a* are surely stopped at their adequate positions on the tray 11 since a particular number of output pulses is assigned to each sheet size beforehand. All the movements described so far are completed during the interval between the start of the two-sided copy mode operation and the arrival of a sheet S at the tray 11. As a sheet S enters the tray 11, the pulse motor 26 moves the side fences 20*a* slightly away from each other by a distance a and, just before the sheet S falls onto the bottom plate 22, toward each other by the distance a. When a plurality of sheets S are fed continuously, such a movement of the side fences 20*a* is repeated until all the sheets S have been stacked on the tray 11. Then, the side fences 20*a* are shifted toward each other to their predetermined positions for regulating the sheets S. In practice, the above-mentioned distance a may be 10 to 15 millimeters. While the sheets S stacked on the tray 11 are refed one after another, the lowermost one being first, the side fences 20 are not moved so as to play the role of a guide. This is successful in freeing the sheets S from skew.

Figure 4:
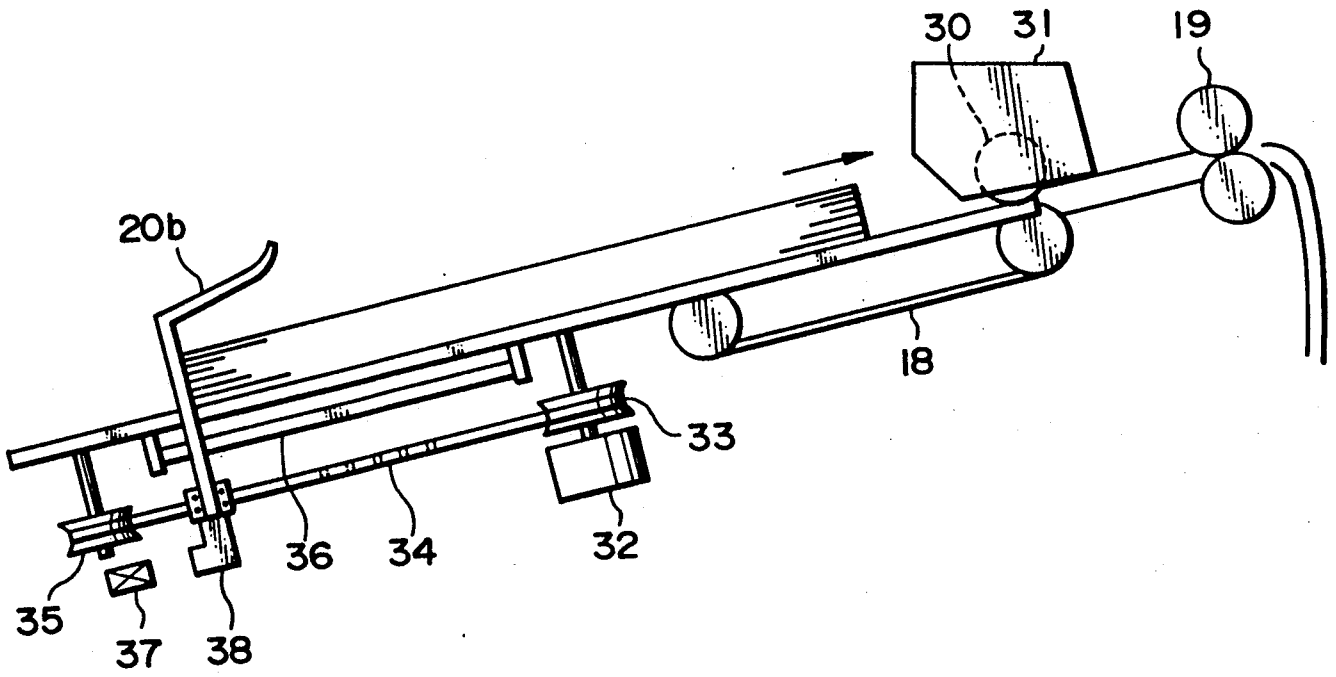
FIG. 4 is a side elevation showing a back fence also provided on the intermediate tray and a drive mechanism associated therewith.

The back fence 20*b* is controlled in substantially the same manner as the side fences 20*a*. Specifically, as shown in FIG. 4, arranged around the back fence 20*b* are the endless belt 18 for refeed, the grip roller 19, the separating roller 30, an air chamber 31 associated with the air knife, a pulse motor 32 for driving the back fence 20*b*, a third pulley 33, a timing belt 34 affixed to a part of the back fence 20*b*, a fourth pulley 35, a guide rail 36 for the back fence 20*b*, a photointerrupted 37 for the back fence 20*b*, and an interrupting piece 38 affixed to a part of the back fence 20*b*. The photointerrupter 37 is located at the home position of the back fence 20*b* and constitutes a back fence home position sensor in cooperation with the interrupting piece 38.

On the start of a two-side copy mode operation, the pulse motor 32 is rotated in a direction for shifting the back fence 20*b* rearward in the intended direction of sheet feed. As soon as the photointerrupter 37 senses the interrupting piece 38, i.e., on the arrival of the back fence 20*b* at the home position, the pulse motor 32 is deenergized. Subsequently, the pulse motor 32 is rotated in the other direction for shifting the back fence 20*b* forward. Again, since a particular number of output pulses is assigned to each sheet size, the back fence 20*b* is surely moved to and stopped at the position matching the size of sheets S which will arrive at the intermediate tray 11. The position where the back fence 20*b* is to stop is such that the leading edge of the sheet stack on the tray 11 is located at a predetermined distance from the separating roller 30 with no regard to the sheet size. The movements described so far are also completed during the interval between the start of the two-sided copy mode operation and the arrival of a sheet S at the tray 11. The difference is that the back fence 20*b* does not move either during the stacking period or during the refeeding period.

The displacements of the side fence 20*a* as measured from the home position will be described. Assume that the inner end of the side fence 20*a* is located at a distance of L=250 millimeters from the center line l when the side fence 20*a* is in the home position. Then, to position a sheet S of size A3 which has a prescribed width of 420 millimeters as measured in the lengthwise direction, the side fence 20*a* has to move the distance L−420/2 millimeters, i.e., 40 millimeters toward the center line l away from the home position. Let this distance be labeled LA3. Assuming that the side fence 20*a* moves 0.5 millimeters in response to one step of rotation of the pulse motor 26, then the number of pulses PA3 necessary for the side fence 20*a* to move the distance LA3 is expressed as PA3=LA3/0.5=80 (pls).

Figures 5, 6:
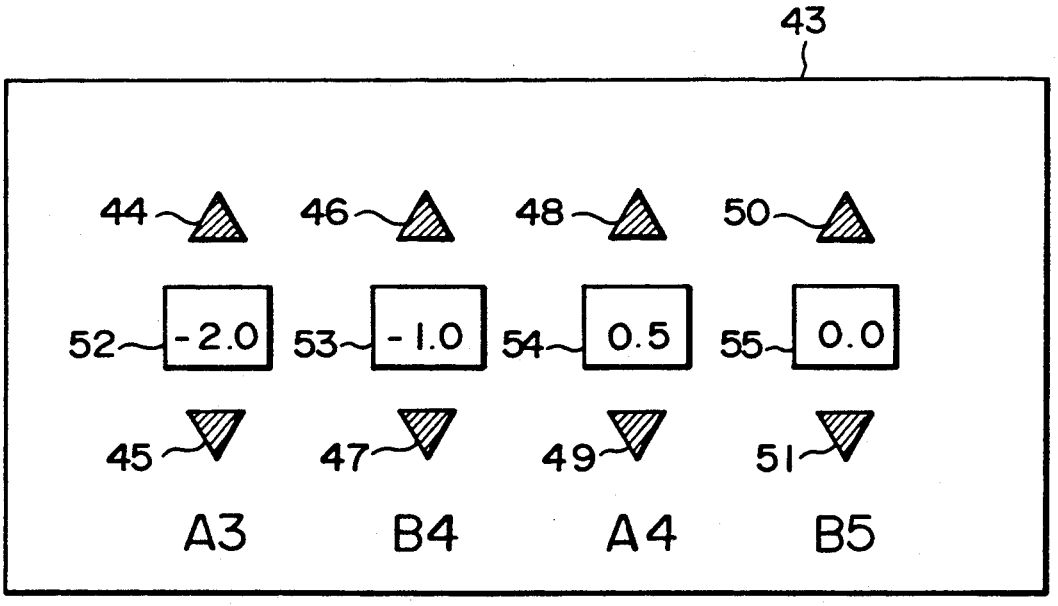
FIG. 5 shows a data table listing displacements of the side fences each being assigned to a particular sheet size, and numbers of pulses associated with the individual displacement.
FIG. 6 is a plan view showing a specific configuration of an adjustment panel with which the present invention is practicable.

FIG. 5 tabulates the correspondence between the distance L which the side fence 20*a* moves and the number of pulses P of the pulse motor, which is predetermined on a sheet size (W) basis. The table shows data associated with sheet sizes B4, A4 and B5 in addition to the data associated with size A3. By using such a data table, a CPU which will be described generates the number of pulses P matching a particular sheet size and thereby causes the pulse motor 26 to move the side fence 20*a* to an adequate position.

Referring to FIG. 6, there is shown a specific configuration of a serviceman-oriented adjustment panel 43 accessible for adjusting the position of the side fence 20*a*. This panel 43 is provided on the operation board of the copier shown in FIG. 1 and with which the present invention is practiced. As shown, the adjustment panel 43 is made up of a liquid crystal type dot matrix display panel and a touch sensor sheet laid on the display panel. When a serviceman sets up a serviceman-oriented screen mode and then presses a predetermined key, the screen shown in FIG. 6 appears. The panel 43 has thereon an up key 44 and a down key 45 assigned to size A3, an up key 46 and a down key 47 assigned to size B4, an up key 48 and a down key 49 assigned to size A4, and an up key 50 and a down key 51 assigned to size B5. Also provided on the panel 43 are display windows 52, 53, 54 and 55 each being assigned to particular size for displaying the amount of adjustment.

When any one of the up and down keys mentioned above is pressed, the numerical value appearing in the associated display window and the numerical value in a built-in memory adapted for control change. Specifically, the numerical value changes by 0.5 millimeter in the display window and by 1 in the memory every time the key is pressed. Assume that the serviceman intends to shift the side fence 20*a* inward by 2 millimeters from the position which was set at the time of shipment. Then, the serviceman presses the down key 45 four times on the screen shown in FIG. 6. As a result, "−2 mm" appears in the display window 52 while "−4" is written to the location of the memory which is indicated by P_ADJ_A3. Likewise, "−2", "+1" and "0" are written to the locations of the memory indicated by P_ADJ_B4, P_ADJ_A4, and P_ADJ_B5, respectively.

After the above setting has been completed, the CPU moves the side fence 20*a* to the home position and then delivers pulses the number of which is the difference between the number of pulses shown in the data table of FIG. 5 and the amount of adjustment. In the case of size A3, for example, the CPU substracts −4 from 80 and thereby feeds 84 pulses (pls). As a result, the side fence 20*a* is shifted inward by 2 millimeters. It is to be noted that such an amount of adjustment is preserved in a non-volatile memory even after the power source of the copier has been turned off.

Figure 7:
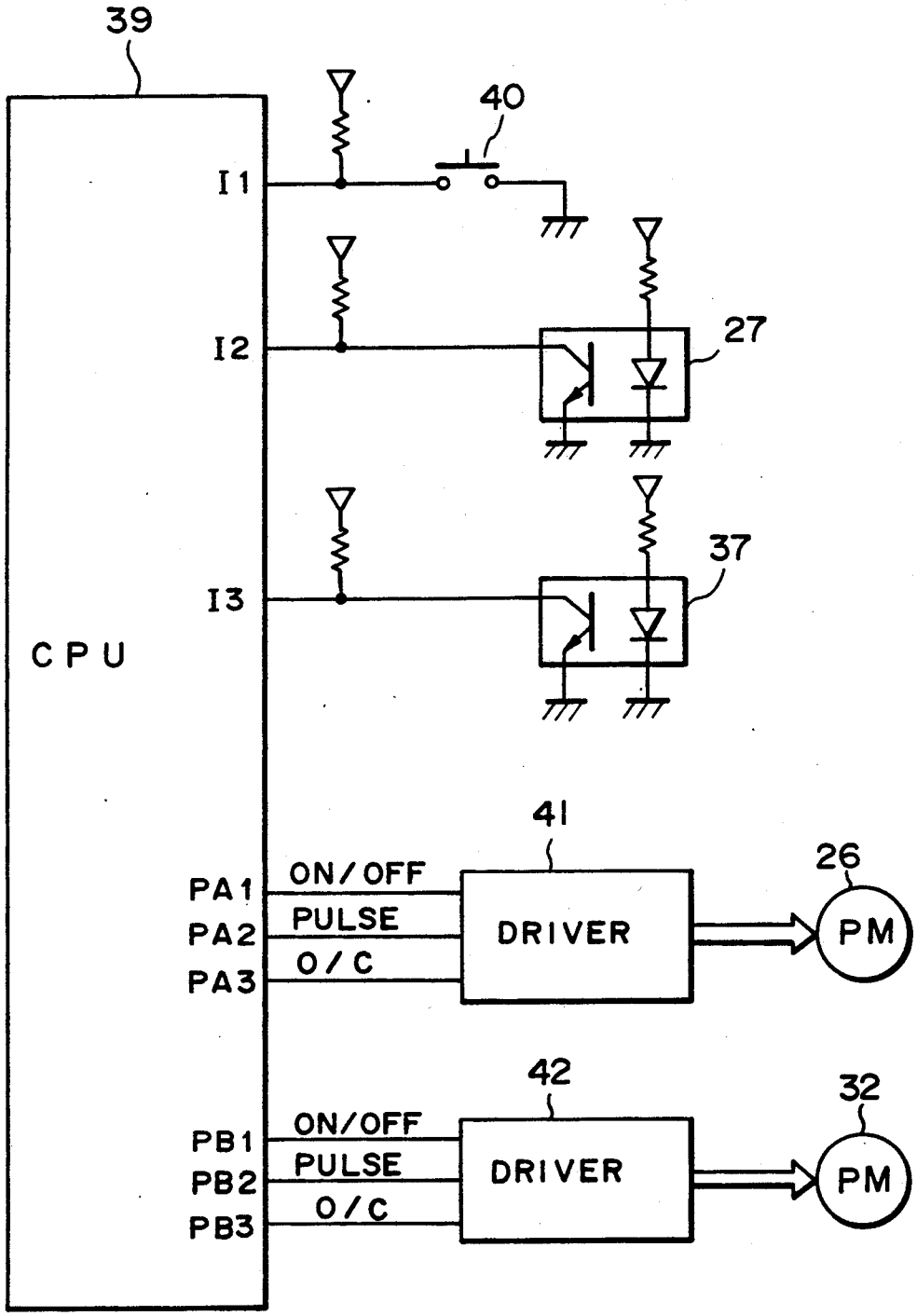
FIG. 7 is a block diagram schematically showing a preferred embodiment of the control device in accordance with the present invention.

Referring to FIG. 7, a preferred embodiment of the control device in accordance with the present invention will be described. As shown, the control device has a CPU 39 which includes a control program, memory, microprocessor, etc. The CPU 39 has ports I1, I2 and I3 connected to a switch 40, the photointerrupter 27, and the photointerrupter 37, respectively. The switch 40 commands the start of a copying operation. The CPU 39 is also connected to drivers 41 and 42 for driving the pulse motors 26 and 32, respectively. A power signal ON/OFF, a pulse signal PULSE and an open/close signal O/C are fed from the CPU 39 to the driver 41 via ports PA1, PA2 and PA3, respectively. Likewise, a power signal ON/OFF, a pulse signal PULSE and an open/close signal O/C are fed from the CPU 39 to the driver 42 via ports PB1, PB2 and PB3, respectively. Assume that the power signal ON/OFF from the port PA1 of the CPU 39 is turned to a low level or "L" to energize the pulse motor 26, and the pulse signal PULSE is fed. Then, the pulse motor 26 is rotated in the direction for moving the side fence 20*a* away from the center line l if the open/close signal O/C is in a high level or "H" or in the direction for moving it toward the center line l if the signal O/C is "L".

Figures 8, 8A:
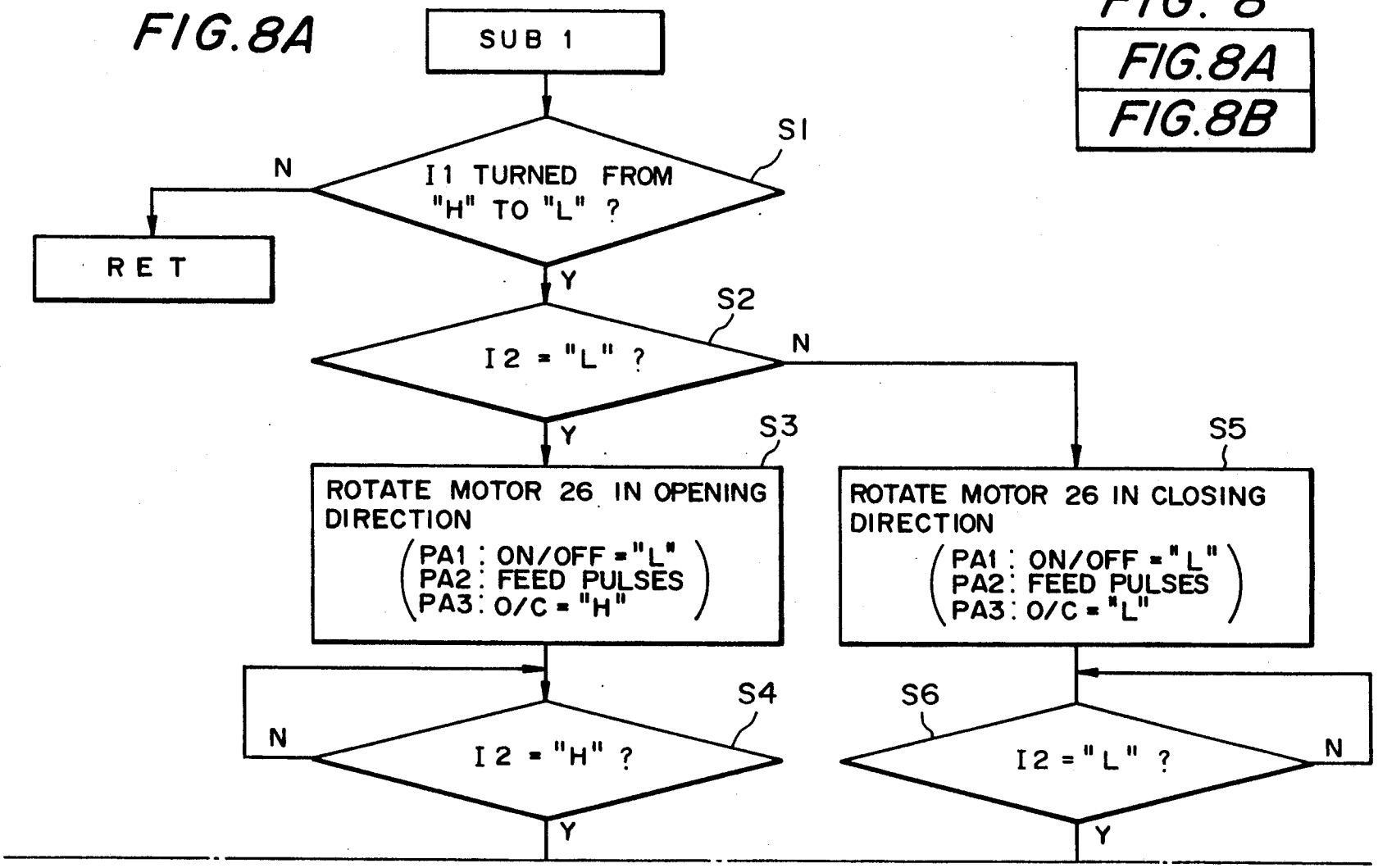
FIGS. 8A and 8B show a flowchart representative of a specific operation flow of the illustrative embodiment.
Figure 8B:
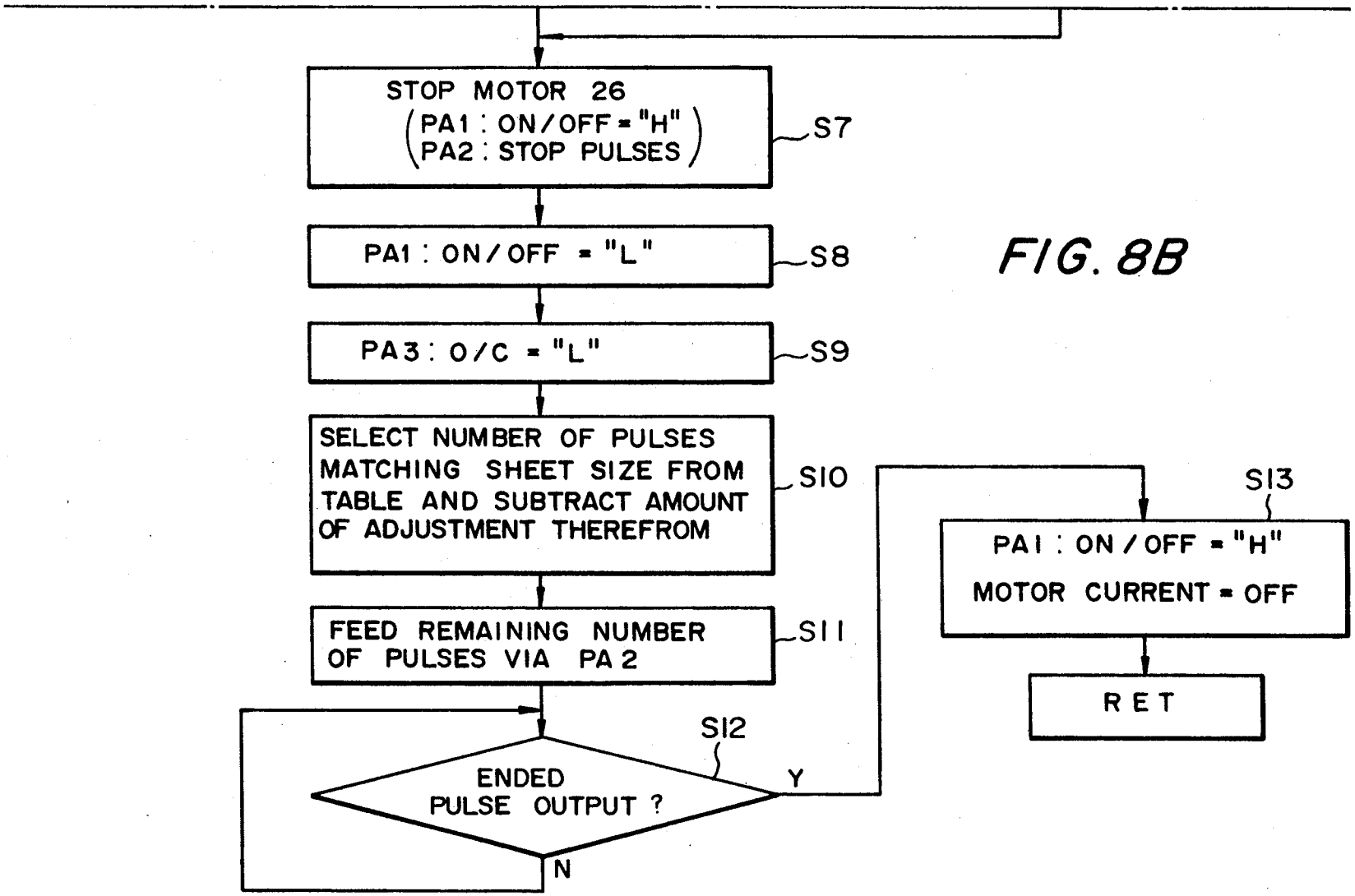

FIG. 8 demonstrates a specific operation flow of the control device having the above construction. The flow begins with a step S1 for determining whether or not a copy start command has been entered. If the answer of the step S1 is positive (Y), whether or not the port I2 of the CPU 39 is "L" is determined (S2). Since the port I2 is connected to the photointerrupter 27, that the port I2 is "L" means that the interrupting piece 29 has not reached the home position where the photointerrupter 27 is located. Then, the pulse motor 26 is rotated in the direction for moving the side fence 20*a* away from the center line l and then stopped when the latter reaches the home position (S3, S4 and S7). On the other hand, that the port I2 is not "L" means that the interrupting piece 29 has already been positioned in the photointerrupter 27. This, however, does not always indicate that the side fence 20*a* is accurately located in the home position, i.e., it is likely that the side fence 20*a* has moved beyond the home position. In this case, therefore, the CPU 39, FIG. 7, rotates the pulse motor 26 in the direction for moving the side fence 20*a* toward the center line l and, when the interrupting piece 29 is about to leave the photointerrupter 27, determines that the side fence 20*a* has reached the home position and, therefore, deenergizes the pulse motor 26 (S5, S6 and S7). Subsequently, the CPU 39 feeds to the pulse motor 26 pulses the number of which is the difference between the particular value of the data table, FIG. 5, and the amount of adjustment (inclusive of a negative value) (S8, S9, S10 and S11). After feeding the last pulse, the CPU 39 deenergies the pulse motor 26 (S12 and S13).

The above-described adjustment procedure is similarly applicable to the back fence 20*b*, although not described to avoid redundancy.

In summary, in accordance with the present invention, the positions of side and back fences each is finely adjustable on the operation board of a copier in matching relation to the size of paper sheets to be stacked on an intermediate or two-side tray. This allows paper sheets to be accurately positioned with no regard to their size.

Various modification will become possible for those skilled in the art after receiving the teachings of the present disclosure without departing from the scope thereof.

What is claimed is:

1. A device for controlling positioning of a sheet carrying an image on one side thereof in a predetermined position on an intermediate tray of a copier which is operable in a two-sided copy mode, said device comprising:

sheet position regulating means movably provided on the intermediate tray for positioning the sheet, which has been transported to and stacked on the intermediate tray and will be refed, in the predetermined position;

drive means for moving and stopping said sheet position regulating means at a desired position;

control means for controlling said sheet position regulating means and said drive means such that an amount of displacement of said sheet position regulating means driven by said drive means is set in response to a given command which is entered on an operation board of the copier; and an adjustment means for adjusting the amount of displacement of said sheet position regulating means set by said control means in response to said given command entered on said operation board.

2. A device as claimed in claim 1, wherein said sheet position regulating means comprises a pair of side fences and a back fence.

3. A device as claimed in claim 2, wherein said drive means comprises pulse motors each for driving respective one of said side fences and said back fence.

4. A device as claimed in claim 3, wherein said control means comprises a memory for storing a data table listing amounts of displacement of said side fences and said back fence and numbers of pulses for driving said pulse motors on a sheet size basis associated with each given command, said adjusting means including means for changing the number of pulses for driving said pulse motors to adjust the amount of displacement of each of said fences.

5. A device as claimed in claim 2, wherein said control means controls said drive means such that as the sheet enters the tray said side fences are moved away from each other by a predetermined distance and, just before the sheet falls onto the tray, toward each other by said predetermined distance, whereby the sheet is positioned in said predetermined position on the tray.

6. A device as claimed in claim 2, wherein said control means controls said drive means such that said back fence is shifted rearward in an intended direction of sheet feed and stopped a home position and subsequently shifted forward and stopped at a position matching a size of the sheet which will arrive at the tray.

* * * * *

UNITED STATES PATENT AND TRADEMARK OFFICE

CERTIFICATE OF CORRECTION

PATENT NO. : 5,110,113

DATED : May 5, 1992

INVENTOR(S) : Koichi Kanaya

It is certified that error appears in the above-identified patent and that said Letters Patent is hereby corrected as shown below:

On the title page, item (30):

The foreign application priority data is incorrect, should be, --Aug. 1, 1989 [JP] Japan.....1-197940--.

Signed and Sealed this

Seventeenth Day of August, 1993

Bruce Lehman

*Attest:*

BRUCE LEHMAN

*Attesting Officer*

*Commissioner of Patents and Trademarks*